US011527827B2

(12) United States Patent
Tlusty

(10) Patent No.: US 11,527,827 B2
(45) Date of Patent: Dec. 13, 2022

(54) ANTENNA ELEMENT FOR WIRELESS COMMUNICATION

(71) Applicant: TE Connectivity Services GmbH, Schaffhausen (CH)

(72) Inventor: Jeffrey F. Tlusty, Auburn Hills, MI (US)

(73) Assignee: TE Connectivity Solutions GmbH

( * ) Notice: Subject to any disclaimer, the term of this patent is extended or adjusted under 35 U.S.C. 154(b) by 0 days.

(21) Appl. No.: 17/232,199

(22) Filed: Apr. 16, 2021

(65) Prior Publication Data

US 2022/0336951 A1 Oct. 20, 2022

(51) Int. Cl.
*H01Q 5/50* (2015.01)
*H01Q 5/10* (2015.01)
*H01Q 5/307* (2015.01)

(52) U.S. Cl.
CPC ..... *H01Q 5/50* (2015.01); *H01Q 5/10* (2015.01); *H01Q 5/307* (2015.01)

(58) Field of Classification Search
CPC ..... H01Q 5/15; H01Q 5/50; H01Q 5/307
See application file for complete search history.

(56) References Cited

U.S. PATENT DOCUMENTS 4,063,246 A * 12/1977 Greiser ..... H01Q 21/065 343/846
6,337,666 B1 1/2002 Bishop
6,559,809 B1 5/2003 Mohammadian et al.
7,965,242 B2 6/2011 Abramov et al.
9,680,213 B2 6/2017 Pan et al.
2015/0022417 A1* 1/2015 Pan ..... H01Q 9/40 343/843
2016/0164185 A1* 6/2016 Park ..... H01Q 1/24 343/700 MS
2020/0028248 A1* 1/2020 Kerselaers ..... H01Q 1/3275

FOREIGN PATENT DOCUMENTS

CN 107425259 A * 12/2017 ..... H01Q 1/36
KR 100652016 B1 * 12/2006
KR 20120004250 A * 1/2012
KR 20140132780 A * 11/2014
KR 102151636 B1 * 9/2020

* cited by examiner

*Primary Examiner* — Dameon E Levi
*Assistant Examiner* — Leah Rosenberg

(57) ABSTRACT

An antenna element includes a first conductor at a first lateral surface of a substrate having a feed line portion and a monopole portion with a neck extending from the feed line portion and a head at a distal end of the neck. The head has a width greater than a width of the neck and greater than a width of the feed line portion. The head has a slot to increase a bandwidth of the first conductor to at least a first frequency band and a second frequency band. A second conductor is provided on the first lateral surface having first and second ground planes and first and second stubs. The ground planes are disposed adjacent to the feed line portion at opposite sides thereof. The stubs are disposed at opposite sides of the ground planes and extend in a direction essentially parallel to the feed line portion. The ground planes and the stubs are arranged relative to the first conductor to form a coplanar waveguide.

20 Claims, 5 Drawing Sheets

ANTENNA ELEMENT FOR WIRELESS COMMUNICATION

BACKGROUND OF THE INVENTION

The subject matter herein relates generally to antenna elements for wireless communications.

In the field of vehicular communication, specific antenna elements are provided for wireless communication. For instance, in automotive applications, roof-top antenna assemblies have been designed to incorporate multiple antenna elements for communication at various frequencies and with various devices, such as analog and digital radio reception, cellular communication, satellite communication and vehicle-to-everything (V2X) communication, WIFI™ communication, Bluetooth™ communication, and the like. It is desirable to incorporate the various antenna elements into a roof-top antenna assembly. However, positioning the multiple antenna elements in the same roof-top antenna assembly may negatively affect the functionality of the various antenna elements. The sizing and positioning of the antenna elements may be limited to geometrically fit into the housing of the roof-top antenna assembly.

A need remains for an antenna element that may be operable in multiple frequencies for wireless communication at multiple frequency bands.

BRIEF DESCRIPTION OF THE INVENTION

In one embodiment, an antenna element is provided and includes a substrate has at least a first lateral surface. A first conductor is provided on the first lateral surface. Said first conductor includes a feed line portion and a monopole portion. The monopole portion includes a neck extending from the feed line portion and a head at a distal end of the neck. The head has a width greater than a width of the neck and greater than a width of the feed line portion. The head has a slot to increase a bandwidth of the first conductor to at least a first frequency band and a second frequency band. A second conductor is provided at least partially on the same, first lateral surface. The second conductor includes a first ground plane and a first stub extending from the first ground plane. The second conductor includes a second ground plane and a second stub extending from the second ground plane. The first and second ground planes are disposed on the first lateral surface adjacent to the feed line portion of the first conductor at opposite sides thereof. The first and second stubs are disposed on the first lateral surface at opposite sides of the respective first and second ground planes. The first and second stubs extend in a direction essentially parallel to the feed line portion of the first conductor. The first and second ground planes and the first and second stubs of the second conductor are arranged relative to the first conductor to form a coplanar waveguide.

In another embodiment, an antenna element is provided and includes a substrate having at least a first lateral surface. A first conductor is provided on the first lateral surface. Said first conductor includes a feed line portion and a monopole portion. The monopole portion includes a neck extending from the feed line portion and a head at a distal end of the neck. The head has head segments surrounding a slot to increase a bandwidth of the first conductor to at least a first frequency band and a second frequency band. The slot has a slot width greater than a slot height of the slot. A second conductor is provided at least partially on the same, first lateral surface. The second conductor includes a first ground plane and a first stub extending from the first ground plane.

The second conductor includes a second ground plane and a second stub extending from the second ground plane. The first and second ground planes are disposed on the first lateral surface adjacent to the feed line portion of the first conductor at opposite sides thereof. The first and second stubs are disposed on the first lateral surface at opposite sides of the respective first and second ground planes. The first and second stubs extend in a direction essentially parallel to the feed line portion of the first conductor. The first and second ground planes and the first and second stubs of the second conductor are arranged relative to the first conductor to form a coplanar waveguide.

In a further embodiment, an antenna element is provided and includes a substrate having at least a first lateral surface. The antenna element includes a first conductor provided on the first lateral surface. Said first conductor includes a feed line portion and a monopole portion. The monopole portion includes a neck extending from the feed line portion and a head at a distal end of the neck. The head has head segments surrounding a slot to increase a bandwidth of the first conductor to cover a Bluetooth™ frequency band, a low WIFI™ frequency band, a high WIFI™ frequency band, and a V2X dedicated short range communication (DSRC) frequency band. The antenna element includes a second conductor provided at least partially on the same, first lateral surface. The second conductor includes a first ground plane and a first stub extending from the first ground plane. The second conductor includes a second ground plane and a second stub extending from the second ground plane. The first and second ground planes are disposed on the first lateral surface adjacent to the feed line portion of the first conductor at opposite sides thereof. The first and second stubs are disposed on the first lateral surface at opposite sides of the respective first and second ground planes. The first and second stubs extend in a direction essentially parallel to the feed line portion of the first conductor. The first and second ground planes and the first and second stubs of the second conductor are arranged relative to the first conductor to form a coplanar waveguide.

DETAILED DESCRIPTION OF THE INVENTION

Figure 1:
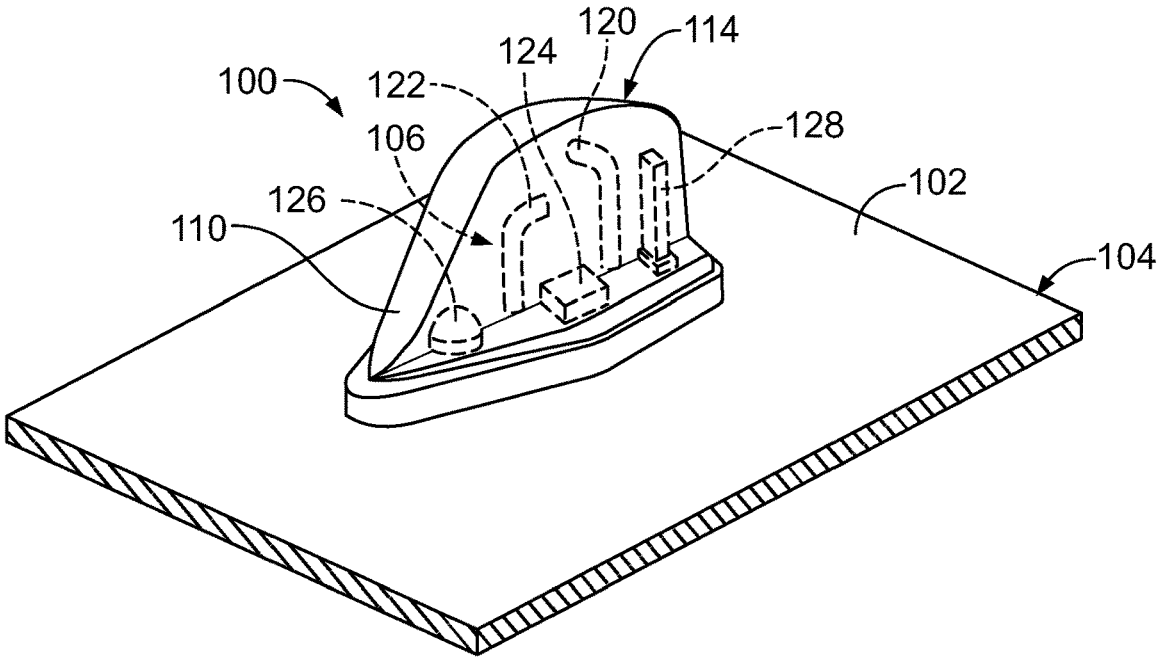
FIG. 1 illustrates an antenna assembly in accordance with an exemplary embodiment.

FIG. 1 illustrates an antenna assembly 100 in accordance with an exemplary embodiment. In an exemplary embodiment, the antenna assembly 100 is a multiband vehicle rooftop antenna assembly. For example, the antenna assembly 100 may be installed on a rooftop 102 of a vehicle 104. In an exemplary embodiment, the antenna assembly 100 integrates multiple antenna elements 106 into a common structure mounted to the vehicle 104 for a multiband antenna automotive system. For example, the antenna assembly 100 may include Dedicated Short Range Communication (DSRC), cellular, and/or satellite antenna elements to provide versatility in communication for the vehicle 104. In an exemplary embodiment, the antenna assembly 100 is operable over DSRC frequencies for "vehicle to everything" communication. For example, one or more of the antenna elements 106 may be operable in a Bluetooth™ frequency band and/or a low WIFI™ frequency band and/or a high WIFI™ frequency band and/or a V2X DSRC frequency band. One or more of the antenna elements 106 may be operable over one or more cellular frequencies (for example, 5G, Long Term Evolution (LTE), and the like). One or more of the antenna elements 106 may be operable over one or more satellite signals (e.g., Satellite Digital Audio Radio (SDARS), Global Navigation Satellite System (GNSS), and the like). The antenna assembly 100 may include antenna elements operable in other frequencies, such as amplitude modulation (AM), frequency modulation (FM), and the like.

The antenna assembly 100 includes an antenna housing 110 holding the antenna elements 106. The antenna housing 110 includes a cover or radome 114 that forms an interior enclosure that receives the antenna elements 106. The antenna elements 106 are covered by the radome 114. Optionally, the radome 114 may be aerodynamically designed, such as having a shark-fin shape. The radome 114 may have other shapes in alternative embodiments, such as disk-shaped, dish-shaped, or shaped as a panel of the vehicle to conform to the exterior of the vehicle. Optionally, the antenna assembly 100 may be inset in the rooftop 102 such that the outer surface of the radome 114 is generally flush with the rooftop 102.

In an exemplary embodiment, the antenna elements 106 of the antenna assembly 100 includes a first or primary cellular antenna 120 configured to be operable over one or more cellular frequencies, a second or secondary cellular antenna 122 configured to be operable over one or more cellular frequencies, a first satellite antenna 124 configured to be operable over one or more satellite frequencies, a second satellite antenna 126 configured to be operable over one or more satellite frequencies, and a V2X antenna 128 configured to be operable over DSRC frequencies, such as Bluetooth™ frequencies, WIFI™ frequencies, and/or V2X DSRC frequencies. In an exemplary embodiment, the first and second cellular antennas 120, 122 may be monopole antennas. The first and second satellite antennas 124, 126 may be patch antennas. The V2X antenna 128 may be a monopole antenna, such as a dual band monopole antenna.

In an exemplary embodiment, the first and second cellular antennas 120, 122 cover a broad frequency range to meet bandwidth requirements of the 5G cellular network. For example, the first and second cellular antennas 120, 122 may cover a frequency range from approximately 617 MHz to 5 GHz. In an exemplary embodiment, the first satellite antenna 124 is used for satellite positioning, such as for use with a GPS system of the vehicle. For example, the first satellite antenna 124 is configured to be operable for receiving Global Navigation Satellite System (GNSS) signals. The first satellite antenna 124 may be a dual band (L1 and L5) antenna element. The first satellite antenna 124 may have a low axial ratio to provide high precision positioning for assisted driving and self-driving. In an exemplary embodiment, the second satellite antenna 126 is used for satellite radio. The second satellite antenna 126 may be operable for receiving satellite digital audio radio services (SDARS) signals (for example, Sirius XM, Telematics Control Unit (TCU), and the like).

In an exemplary embodiment, the V2X antenna 128 is used for communication with the surroundings, such as vehicle-to-vehicle communication, vehicle-to-infrastructure communication, vehicle-to-pedestrian communication, and the like. In an exemplary embodiment, the V2X antenna 128 transmits and/or receives DSRC signals for communication with surrounding or interacting with other vehicles, pedestrians, roadway infrastructure or other networks. In an exemplary embodiment, the V2X antenna 128 is a monopole antenna configured to transmit and receive signals omnidirectionally. The V2X antenna 128 may be operable for receiving Bluetooth™ signals in the 2.4 GHz frequency range. The V2X antenna 128 may be operable for receiving WIFI signals, such as in the 2.5 GHz frequency range and/or the 5 GHz frequency range. The V2X antenna 128 may be operable for receiving V2X DSRC signals, such as in the 5.9 GHz frequency range.

Figure 2:
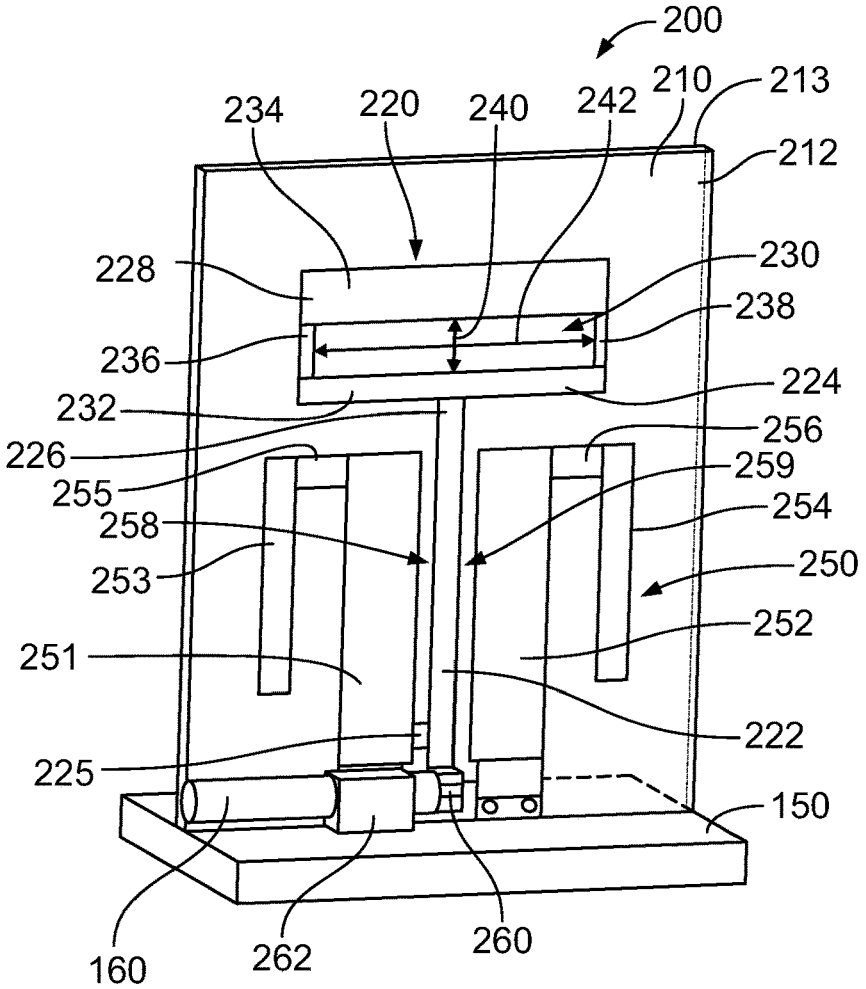
FIG. 2 is a schematic view of an antenna element in accordance with an exemplary embodiment.

FIG. 2 is a schematic view of an antenna element 200 in accordance with an exemplary embodiment. The antenna element 200 may be used as an antenna element 106 of the antenna assembly 100 (shown in FIG. 1). For example, the antenna element 200 may represent the V2X antenna 128 (shown in FIG. 1). In an exemplary embodiment, the antenna element 200 is mounted to a base 150. The base may be a circuit board in various embodiments. The base 150 includes a ground plane to provide a ground reference for the antenna element 200. The base 150 may include feed circuits to feed the antenna element 200. For example, the antenna element 200 may be soldered to circuits or conductors of the base 150, such as connected to the ground plane. Alternatively, as in the illustrated embodiment, the feed for the antenna element 200 may be provided by a cable 160, such as a coaxial cable. The cable 160 may extend along the base 150, such as parallel to the antenna element 200. The cable 160 may be connected at other locations, such as to the bottom of the base 150, and extend from the bottom of the base 150.

The antenna element 200 includes a substrate 210 as a structural element on which a first conductor 220 and a second conductor 250 are disposed. The substrate 210 includes a first lateral surface 212. The first and second conductors 220, 250 may be provided on the first lateral surface 212. Optionally, the first lateral surface may be planar (e.g., flat). In alternative embodiments, the first lateral surface 212 may be non-planar (e.g., curved). In various embodiments, the substrate 210 includes an opposite second lateral surface 213. The second lateral surface 213 may be parallel to the first lateral surface 212 in various embodiments. The first and second lateral surfaces 212, 213 may be front and rear surfaces of the substrate 210. Optionally, the substrate 210 may be oriented such that the first lateral surface 212 is oriented generally vertically (for example, with a longitudinal axis of the substrate 210 oriented vertically).

The substrate 210 is manufactured from a dielectric material in order to prevent a short circuit between the first conductor 220 and the second conductor 250. The substrate 210 may be manufactured from a material that provides, at desired frequencies, for low losses in terms of quality factor, or dissipation factor, for a particular permittivity or dielectric constant. For example, the substrate 210 may be manufactured from epoxy- or polyamide-based materials. Other exemplary materials to be used for the substrate 210 could be FR4, PC (polycarbonate) or ABS (acrylonitrile butadiene styrene). The substrate 210 provides structural support and thereby separates the first conductor 220 from the second conductor 250 such that both conductors 220 and 250 have distinct shapes of conducting material. In various embodiments, the substrate 210 is a circuit board and the conductors 220, 250 may be circuits of the circuit board on one or more layers of the circuit board.

The first conductor 220 includes a feed line portion 222 and a monopole portion 224 extending from the feed line portion 222. For example, the monopole portion 224 may be located above the feed line portion 222. The first conductor 220 is disposed on the first lateral surface 212, for instance at a front face, of the substrate 210. In an exemplary embodiment, the antenna element 200 includes a resistor 225 between the feed line portion 222 the second conductor 250. The resistor 225 may be provided on the substrate 210, such as on the first lateral surface 212. A distinction between the feed line portion 222 and the monopole portion 224 of the first conductor 220 is made in view of its functionality in combination with the second conductor 250, as will be explained in more detail below. The intersection between feed line portion 222 and monopole portion is called antenna feed point F.

In an exemplary embodiment, the monopole portion 224 is non-linear. The monopole portion 224 includes a neck 226 and a head 228 at a distal end of the neck 226. For example, the head 228 is located above the neck 226. The neck 226 extends between the feed line portion 222 and the head 228. The neck 226 may be an extension of the feed line portion 222 (for example, having the same width and extending in a common direction). The head 228 is wider than the neck 226. In an exemplary embodiment, the head 228 includes a slot 230 surrounded by a plurality of head segments. The head segments may form a rectangular antenna structure. For example, the head 228 includes a lower segment 232, an upper segment 234 and side segments 236, 238 extending between the lower segment 232 and the upper segment 234. Optionally, the upper and lower segments 232, 234 may be oriented parallel to each other. Optionally, the side segments 236, 238 may be oriented perpendicular to the upper and lower segments 232, 234. Greater or fewer head segments may be provided to change the shape of the head 228 and the shape of the slot 230, such as for tuning the antenna element 200 to a target frequency.

The slot 230 is open (for example, devoid of conductors) between the upper and lower segments 232, 234 and between the first and second side segments 236, 238. The slot 230 has a slot height 240 between the upper and lower segments 232, 234 and a slot width 242 between the first and second side segments 236, 238. The slot height 240 and the slot width 242 may be controlled based on widths and heights of the head segments. The slot 230 increases bandwidth of the first conductor 220 to cover Bluetooth™ and WiFi™ Low frequency bands. The slot 230 enhances performance at the WiFi™ High frequency band and the DSRC frequency band.

The second conductor 250 is at least partially disposed on the first lateral surface 212 of the substrate 210. The second conductor 250 includes a first ground plane 251 and a second ground plane 252 flanking the first conductor 220. In an exemplary embodiment, the second conductor 250 includes a first stub 253 extending from the first ground plane and a second stub 254 extending from the second ground plane 252. The second conductor 250 may include additional stubs in alternative embodiments. In an exemplary embodiment, the first and second stubs 253, 254 are electrically connected to the first and second ground planes 251, 252 via first and second link portions 255, 256, respectively.

The ground planes 251, 252 are disposed on the first lateral surface 212 adjacent to the feed line portion 222 of the first conductor 220 at opposite sides thereof. For example, the first ground plane 251 is disposed on a right side of the feed line portion 222 and the second ground plane 252 is disposed on a left side of the feed line portion 222 of the first conductor 220. The terms "left side" and "right side" refer to a front-side-up orientation of the first conductor 220. In an exemplary embodiment, the ground planes 251 and 252 are provided equidistantly at opposite sides of the feed line portion 222 of the first conductor 220. In other words, the spacing or distance between the feed line portion 222 of the first conductor 220 and the ground plane 251 and 252 of the second conductor 250 is same on both opposite sides. In an exemplary embodiment, the first ground plane 251 is separated from the feed line portion 222 by a first gap and the second ground plane 252 is separated from the feed line portion 222 by a second gap. In an exemplary embodiment, the resistor 225 extends across the first gap between the feed line portion 222 and the first ground plane 251; however, the resistor 225 may additionally or alternatively extend across the second gap between the feed line portion 222 and the second ground plane 252.

In the exemplary embodiment, the links 255, 256 extend from the distal ends of the ground planes 251, 252. As such, the stubs 253, 254 are coupled to the ground planes 251, 252 near the antenna feed point F, namely near the intersection between the feed line portion 222 and the monopole portion 224. In an exemplary embodiment, the first and second stubs 253, 254 extend generally parallel to the first and second ground planes 251, 252. The stubs 253, 254 are located outside of the ground planes 251, 252. In an exemplary embodiment, the first and second stubs 253, 254 are turned downwardly from the first and second links 255, 256 and extend toward the base 150. The first and second links 255, 256 extend therebetween and define the spacing between the stubs 253, 254 and the ground planes 251, 252. For example, the first link 255 defines a first spacing 258 between the first ground plane 251 and the first stub 253 and the second link 256 defines a second spacing 259 between the second ground plane 252 and the second stub 254. The first and second stubs 253, 254 do not reach into areas next to (i.e. adjacent to) the monopole portion 224 of the first conductor 220. Accordingly, the configuration of the antenna element 200 preserves an open space at opposite sides of the monopole portion 224 of the first conductor 220. The first and second stubs 253, 254 extend in a direction that is essentially parallel to the feed line portion 222 of the first conductor 220. With the monopole portion 224 being in line with the feed line portion 222 of the first conductor 220, the stubs 253 and 254 also extend in a direction that is essentially parallel to the monopole portion 224.

The ground planes 251, 252 and the stubs 253, 254 together form a coplanar waveguide. In the context of the description, the term "coplanar" or "planar" shall not limit the invention to a flat surface (i.e. plane) but shall be construed in the sense as to relate to any surfaces, such as including curved surfaces. In this respect, the expression "ground planes and stubs together form a coplanar waveguide" refers to the fact that both are co-located on the same (either flat or curved) surface and thereby form a waveguide.

The first conductor 220 further includes an RF input 260 for feeding an RF signal to be transmitted via the monopole portion 224 of the first conductor 220. In other words, the RF signal is input via the RF input 260 at a proximal end of the feed line portion 222 of the first conductor 220 to be radiated by the monopole portion 224 of the first conductor 220. The RF signal may be supplied to the RF input 260 via the center conductor of the coaxial cable 160 or a transmission line of a circuit board, such as the base 150. The second conductor 250 further includes a ground connection 262 for supply of a GND signal to the first and second ground planes 251, 252 of the second conductor 250. In other words, the GND signal is input via the ground connection 262 at a proximal end of either of the ground planes 251, 252 to provide a reference voltage for the first conductor 220. The ground planes 251, 252 may be electrically connected to each other through the base 150, such as through vias, traces, and the like, which may be on one or more layers of the base 150. The GND signal may be supplied via the outer conductor of the coaxial cable 160 or a transmission line of the base 150, such as a ground layer of the circuit board at the base 150.

Figure 3:
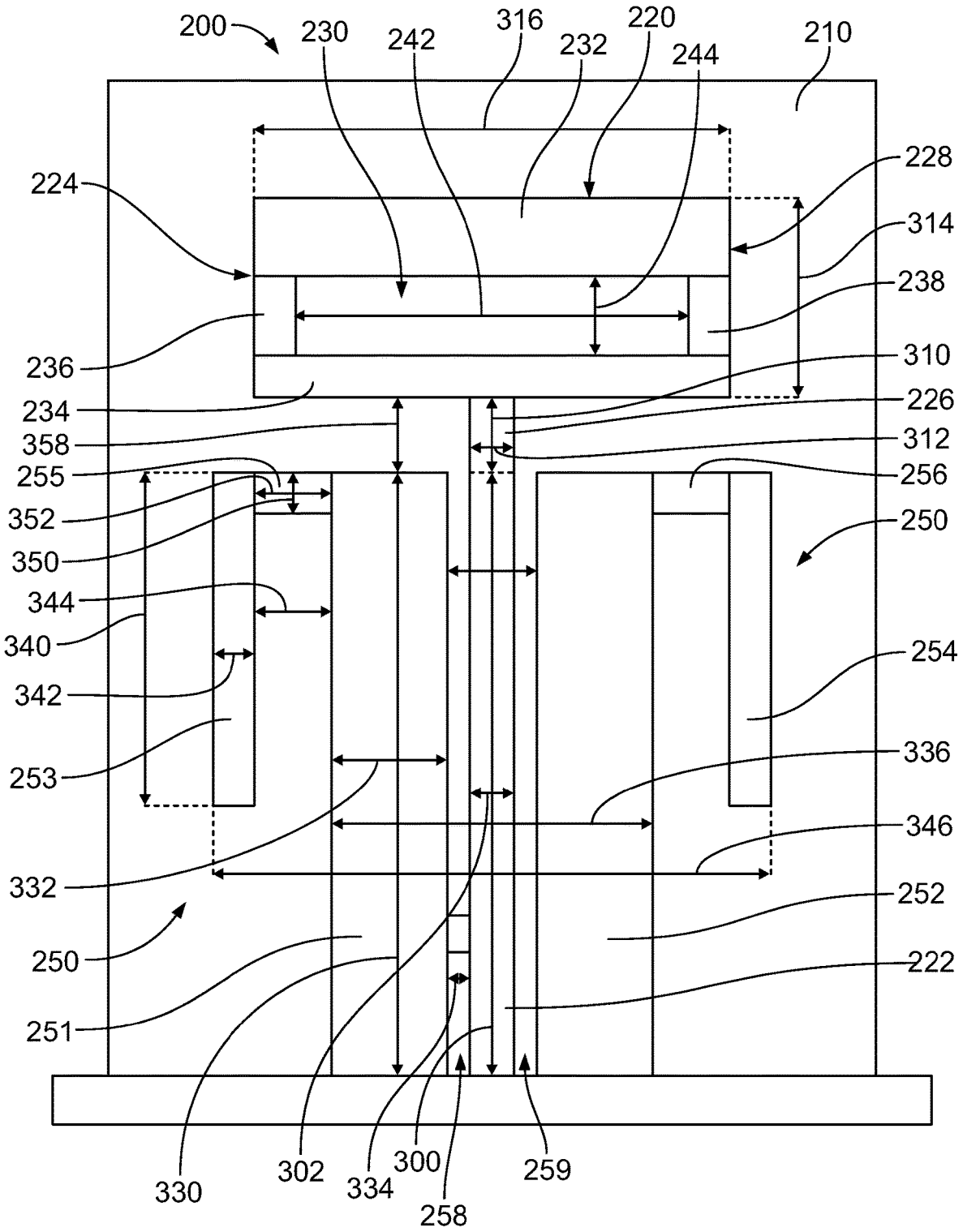
FIG. 3 is a front view of the antenna element in accordance with an exemplary embodiment.

FIG. 3 is a front view of the antenna element 200 in accordance with an exemplary embodiment showing the conductors 220, 250 having sizes and shapes configured for dual band use at frequencies of approximately 2.4 GHz and 5.9 GHz. Changes in sizes and shapes of the conductors 220, 250 may configure the antenna element 200 for use at other target frequencies.

In an exemplary embodiment, the feed line portion 222 of the first conductor 220 is rectangular and has a length 300 of approximately 16 mm and has a width 302 of approximately 1 mm. In an exemplary embodiment, the feed line portion 222 is oriented vertically such that the length 300 defines a height of the feed line portion 222.

In an exemplary embodiment, the monopole portion 224 of the first conductor 220 includes rectangular portions. For example, the neck 226 is rectangular having a length 310 (for example, height) of approximately 2 mm and has a width 312 of approximately 1 mm. The width 312 may be the same as the width 302 of the feed line portion 222. The head 228 is rectangular having a length 314 (for example, height) of approximately 5 mm and has a width 316 of approximately 12 mm. The length 314 and the width 316 are sufficient to accommodate the head segments and the slot 230. For example, the slot width 242 and the slot height 244 are less than the width 316 and the length 314. In the illustrated embodiment, the slot width 242 is approximately 10 mm and the slot height 244 is approximately 2 mm. The head segments have heights and widths, that together with the height and the width of the slot 230, define the length 314 and the width 316 of the head 228. The heights and the widths of the various head segments may be different. In the illustrated embodiment, the upper segment 232 has a height of approximately 1 mm and a width of approximately 12 mm (for example, spans the entire width 316 of the head 228). In the illustrated embodiment, the lower segment 234 has a height of approximately 2 mm and a width of approximately 12 mm (for example, spans the entire width 316 of the head 228). In the illustrated embodiment, the side segments 236, 238 have a height of approximately 2 mm (for example, spans the entire slot height 244) and a width of approximately 1 mm. Other heights and widths are possible in alternative embodiments to change the size and shape of the monopole portion 224 relative to the second conductor 250 to change the antenna characteristics, such as the target frequencies, the return loss, the antenna gain, and the like.

In an exemplary embodiment, the first and second ground planes 251, 252 are similar in size and shape. For example, the first and second ground planes 251, 252 may be mirrored versions of each other on opposite sides of the feed line portion 222. The dimensions described herein are in reference to the first ground plane 251, but may be identical with the second ground plane 252. In alternative embodiments, the first and second ground planes 251, 252 may have different shapes from each other. The first ground plane 251 is rectangular having a length 330 (for example, a height) of approximately 15 mm and having a width 332 of approximately 3 mm. The first gap may have a gap width 334 of approximately 0.5 mm between the first ground plane 251 and the feed line portion 222. In the illustrated embodiment, the antenna element 200 may have an outer edge width 336 of approximately 8 mm from the outer edge of the first ground plane 251 to the outer edge of the second ground plane 252.

In an exemplary embodiment, the first and second stubs 253, 254 are similar in size and shape. For example, the first and second stubs 253, 254 may be mirrored versions of each other on opposite sides of the feed line portion 222. The dimensions described herein are in reference to the first stub 253, but may be identical with the second stub 254. In alternative embodiments, the first and second stubs 253, 254 may have different shapes from each other. The first stub 253 is rectangular having a length 340 (for example, a height) of approximately 8.5 mm and having a width 342 of approximately 1 mm. The first spacing 258 may have a spacing width 344 of approximately 2 mm between the first ground plane 251 and the first stub 253. In the illustrated embodiment, the antenna element 200 may have an outer edge width 346 of approximately 14 mm from the outer edge of the first stub 253 to the outer edge of the second stub 254.

In an exemplary embodiment, the first and second links 255, 256 are similar in size and shape. For example, the first and second links 255, 256 may be mirrored versions of each other on opposite sides of the feed line portion 222. The dimensions described herein are in reference to the first link 255, but may be identical with the second link 256. In alternative embodiments, the first and second links 255, 256 may have different shapes from each other. The first link 255 is rectangular having a length 350 (for example, a height) of approximately 1 mm and having a width 352 of approximately 2 mm. The width 352 may define the first spacing 258 between the first ground plane 251 and the first stub 253. Optionally, the width 352 of the first link 255, and thus the first spacing 258, may correspond to (for example, be approximately equal to) the length 310 (for example, height) of the neck 226. As such, a spacing 358 between the head 228 and the second conductor 250 may be equivalent to the spacing between the ground plane 251 and the stub 253.

The transmission operation of an RF signal by the antenna element 200 is described in more detail. However, the operation of the antenna element 200 is not limited thereto. In particular, the antenna element 200 may similarly be used for reception operation, where the antenna element is excited by an externally radiated signal. An RF signal is input to the RF input 260 of the first conductor 220 and a GND signal is input to the ground connection 262 of the second conductor 250. Due to the ground planes 251, 252 of the second conductor 250, the feed line portion 222 of the first conductor 220 operates as a coplanar transmission line to carry the RF signal received at the RF input 260 to the antenna feed point F. A voltage at the gap between the feed line portion 222 of the first conductor 220 and the two ground planes 251, 252 of the second conductor 250 at the antenna feed point F, as created by the RF signal, causes an RF current to flow on the monopole portion 224 of the first conductor 220. The differential current carried by feed line portion 222 of the first conductor 220 returns to the RF input 260 along the surface of the ground plane 251, 252 of the second conductor 250 that is closest to the feed line portion 222. The energy radiated by the monopole portion 224 of the first conductor 220 may also induce a common mode current that flows away from antenna feed point F along the surface of the two ground planes 251, 252 of the conductor that is closest to the feed line portion 222. Problems may arise, such as unwanted RF radiation from the two ground planes 251 and 252, due to their limited width and length relative to the frequency of operation.

To eliminate or to reduce unwanted RF radiation from the two ground planes 251, 252, the stubs 253, 254 are employed. The common mode current may tend to flow around to the other side of the two stubs 253, 254 (i.e. to the surface of the stubs that is farthest from feed line portion 222) and returns to the distal ends of the stubs 253, 254. In designing an antenna element, the lengths of the two stubs 253 and 254 may be selected to impede a flow of common mode current back to the RF input 260. This impedance effect may be explained by considering that the two ground planes 251, 252 and the two stubs 253, 254 form a coplanar waveguide (CPW) transmission line. According to this model, the two ground planes 251 and 252 form the center conductor of the CPW, and the two stubs 253 and 254 form the outer conductors of the CPW. The waveguide is short-circuited at its distal end by the link portions 255, 256. If the effective length of the CPW is approximately one quarter-wavelength (e.g. at the center frequency of a desired frequency band), then the impedance at the open end of the CPW (e.g. at the proximal ends of the two stubs 253, 254) may be nearly infinite at the operating target frequency. This impedance resists the flow of common mode current back to the source along the two ground planes 251, 252, resulting in a tendency for the antenna element 200 to be more balanced in the sense that radiation by the feed line portion 222 is reduced or eliminated at the target frequency corresponding to the lengths of the stubs 253, 254. In such a case, it may be desirable for the monopole portion 224 of the first conductor 220 to have an effective length of approximately one-quarter wavelength as well corresponding to the frequency at which the stub length was selected for. However, the effective lengths of the monopole portion 224 and the feed line portion 222 may be multiples of one-quarter of the wavelength of the desired frequency. In addition to the resonance that corresponds to the one-quarter wavelength stub and monopole, an additional resonance may be induced by proper selection of the ground plane height relative to the monopole size and stub dimensions. Careful selection of the dimensions allows for dual frequency operation, where the stub and ground plane impacts are minimal at the second frequency band. Dual frequency operation is enhanced when the second resonance is sufficiently spaced apart and the stub dimensions are small relative to a wavelength at the second frequency band (for example, 2.4 GHz and 5.8 GHz, where the stub length is optimized for 5.8 GHz). For example, the quarter wave stubs and head portion of the monopole are optimized for a high frequency band of 5.8 GHz. It is understood that any description of the operation of an antenna element according to an embodiment is presented herein for explanatory purposes only. Notably, such explanation does not itself represent or impose any limitation on any configuration as set forth in the various realizations described above.

The antenna element 200 has dimensions and shape to geometrically fit into a roof-top antenna assembly. The construction of the antenna element 200 allows for a narrow proximal end of the substrate 210. The areas at both sides of the monopole portion 224 of the antenna element 200 are left empty such that no portion of the second conductor 250 (i.e. stubs 253, 254) is disposed at close proximity to the monopole portion 224. At the same time, the stubs 253, 254 can be realized with a same length as monopole portion 224, namely, $\lambda/4$. Accordingly, the antenna element 200 may advantageously be incorporated into a roof-top antenna assembly. In an exemplary embodiment, the antenna element 200 equally realizes the advantage of an omni-directional radiation pattern. Specifically, the construction of the antenna element 200 including the monopole portion 224 sticking out from the second conductor 250 provides for an improved capability to radiate equal power in all directions perpendicular to the extent of the antenna element 200.

Figure 4:
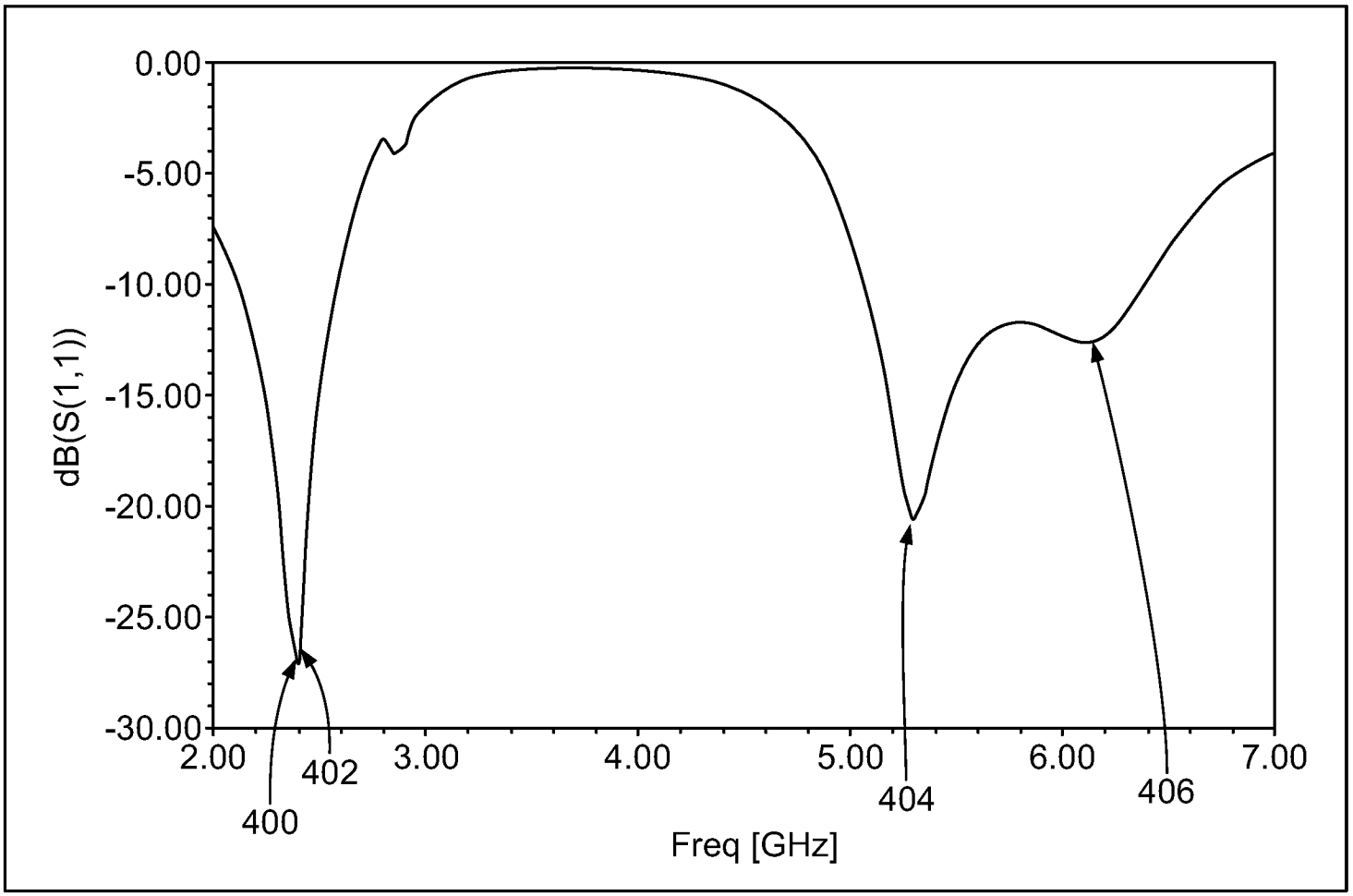
FIG. 4 provide analysis results measured for an exemplary antenna element, such as the antenna element illustrated in FIGS. 2-3 in accordance with an exemplary embodiment.
Figure 5:
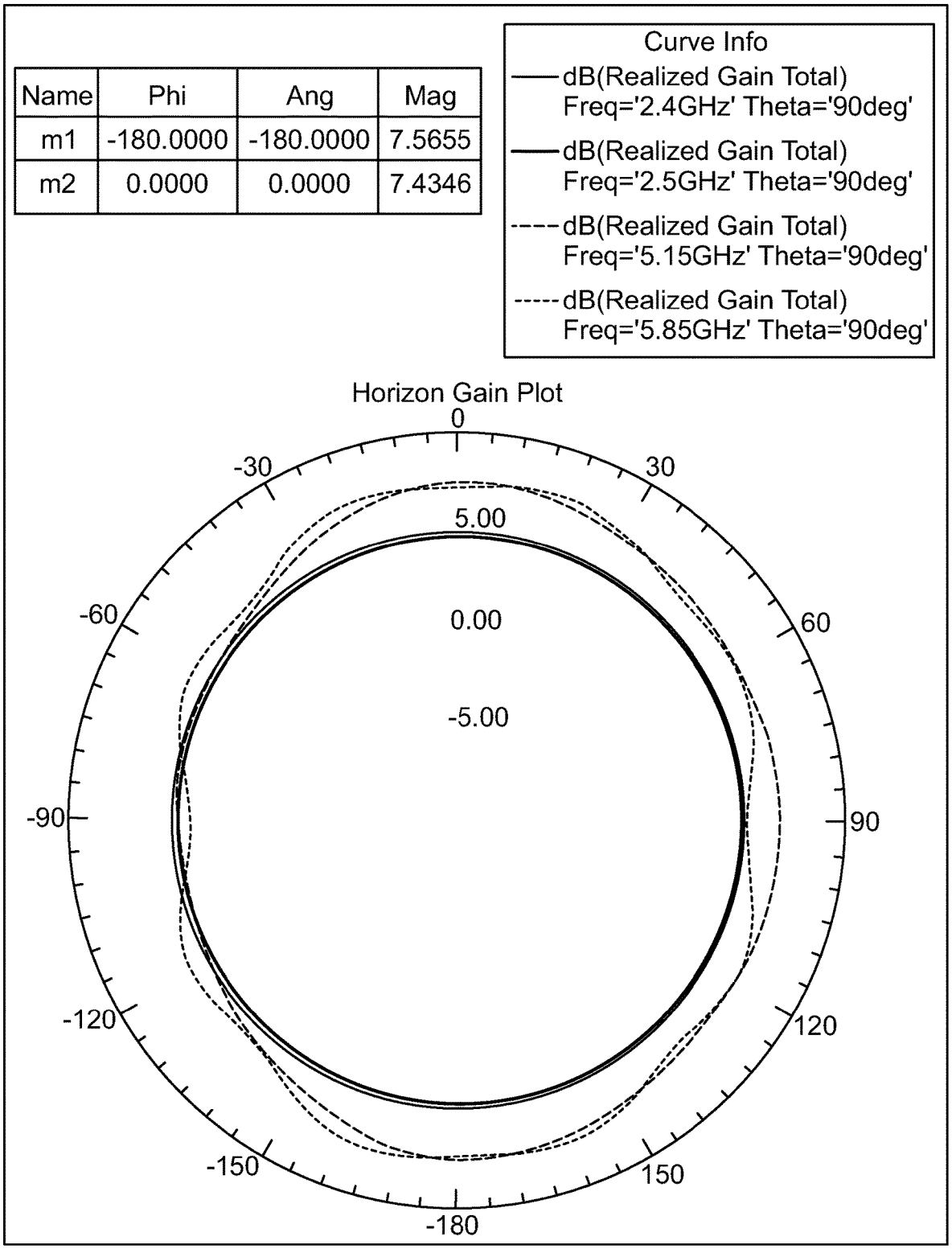
FIG. 5 provide analysis results measured for an exemplary antenna element, such as the antenna element illustrated in FIGS. 2-3 in accordance with an exemplary embodiment.
Figure 6:
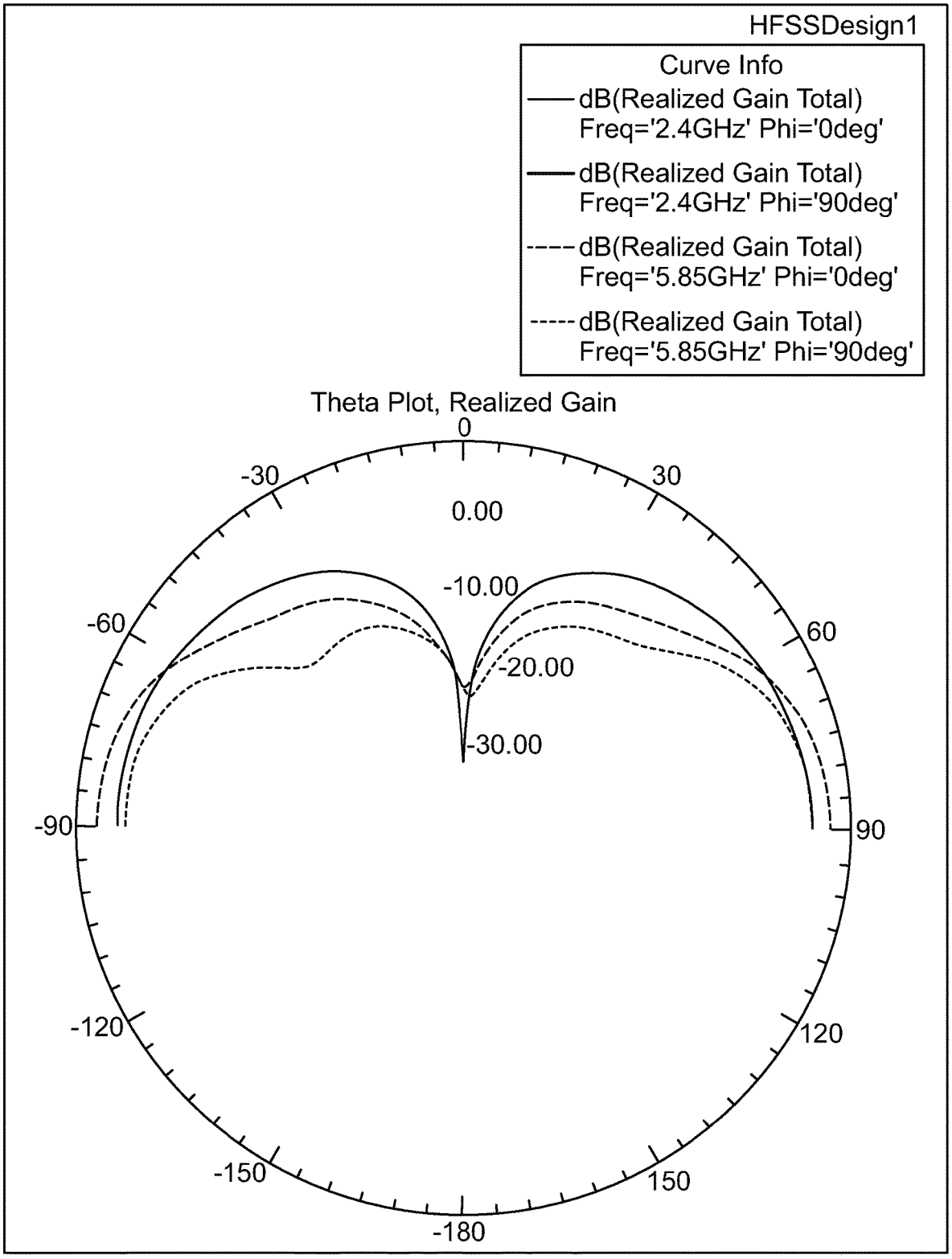
FIG. 6 provide analysis results measured for an exemplary antenna element, such as the antenna element illustrated in FIGS. 2-3 in accordance with an exemplary embodiment.

FIGS. 4-6 provide analysis results measured for an exemplary antenna element, such as the antenna element illustrated in FIGS. 2-3. Losses in the performance are kept at a very low level while providing functional operation in multiple bands, such as to satisfy Bluetooth™ communication and/or WIFI™ communication and/or V2X DSRC communication for a vehicle. The analysis results shown in FIGS. 4 through 6 are provided for purposes of illustration and not for purposes of limitation. Alternative embodiments of the antenna element may be configured differently and have different operational or performance parameters than what is shown in FIGS. 4 through 6.

FIG. 4 is a plot showing impedance matching (S11) for the antenna element 200 in decibels versus frequency in gigahertz for the antenna element 200. The performance of the antenna element 200 satisfies requirements for a vehicular antenna, such as below −5 dB, for operation in desired frequency ranges of 2.4-2.6 GHz and 5-6 GHz. For example, measured reflections 400, 402, 404 and 406 in the Bluetooth™ (2.4 GHz) frequency range, low WIFI™ (2.5 GHz) frequency range, high WIFI™ (5.15 GHz) frequency range, and V2X DSRC (5.85 GHz) frequency range, respectively, are all below −5 dB, and in the illustrated embodiment, even less than −10 dB, to satisfy operation requirements. The antenna element 200 advantageously has sufficient impedance matching in multiple frequency bands. The single antenna element 200 can be used for Bluetooth™ communication, WIFI™ communication and DSRC communication. This allows the antenna element 200 to be used in the field of vehicle communication, such as for vehicle-to-everything communication where it is important for wireless communication with various types of devices on various frequencies.

FIG. 5 is a plot showing a directional radiation pattern of the antenna element 200 in accordance with an exemplary embodiment. The antenna element 200 is omni-directional having gain in all directions. The plot shows the realized gain in a horizontal plane at different frequencies, such as the Bluetooth™ frequency (2.4 GHz), the low WIFI™ (2.5 GHz) frequency, the high WIFI™ (5.15 GHz) frequency, and the V2X DSRC (5.85 GHz) frequency. The realized gain is between approximately 5 dB and 7.5 dB in all directions showing good performance of the antenna element 200 in all directions. FIG. 5 reveals that the antenna gain of the antenna element 200 in the horizontal plane resembles an azimuth pattern yielding an omni-directional pattern at horizon with a variation of less than approximately 2.5 dB. The antenna element 200 advantageously has an omni-directional radiation pattern in the horizontal plane. This allows the antenna element 200 to be used in the field of car-to-car communication where it is important that wireless communication be engaged in any horizontal direction.

FIG. 6 is a plot showing farfield realized gain at varying angles of elevation, with fixed angles of azimuth (0° and 90°) for the antenna element 200 in accordance with an exemplary embodiment. FIG. 6 shows the antenna gain in a vertical plane. FIG. 6 indicates that the antenna element 200 has adequate antenna gain at the relevant vertical angles. For example, the antenna element 200 maintains sufficient power between 30° and 90°. More importantly, between 60° and 90°, the antenna element 200 has positive realized gain at both the Bluetooth™ (2.4 GHz) frequency and the V2X DSRC (5.85 GHz) frequency.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

What is claimed is:

1. An antenna element comprising:

a substrate having at least a first lateral surface, a first conductor provided on the first lateral surface, said first conductor including a feed line portion and a monopole portion, the monopole portion including a neck extending from the feed line portion and a head at a distal end of the neck, the head having a width greater than a width of the neck and greater than a width of the feed line portion, the head having a slot to increase a bandwidth of the first conductor to at least a first frequency band and a second frequency band;

a second conductor provided at least partially on the same, first lateral surface, wherein, the second conductor includes a first ground plane and a first stub extending from the first ground plane, the second conductor includes a second ground plane and a second stub extending from the second ground plane, the first and second ground planes are disposed on the first lateral surface adjacent to the feed line portion of the first conductor at opposite sides thereof, the first and second stubs are disposed on the first lateral surface at opposite sides of the respective first and second ground planes, the first and second stubs extend in a direction essentially parallel to the feed line portion of the first conductor, the first and second ground planes and the first and second stubs of the second conductor are arranged relative to the first conductor to form a coplanar waveguide;

wherein the head of the monopole portion includes a lower segment below the slot, an upper segment above the slot, and side segments between the lower segment and the upper segment at opposite sides of the slot, the width of the head being defined between the side segments, the width of the head being approximately equal to a width of the second conductor defined between the first and second stubs.

2. The antenna element of claim 1, wherein the head includes head segments surrounding the slot, the slot having a slot width greater than a slot height of the slot.

3. The antenna element of claim 1, wherein the head includes head segments surrounding the slot, the head segments and the slot shaped to enhance operation in a Bluetooth™ frequency band, a low WIFI™ frequency band, a high WIFI™ frequency band, and a V2X dedicated short range communication (DSRC) frequency band.

4. The antenna element of claim 1, wherein the feed line portion, the first ground plane, and the second ground plane extend generally vertically, the head being located vertically above the feed line portion, the first ground plane, and the second ground plane.

5. The antenna element of claim 1, wherein the first ground plane has a first width and the second ground plane has a second width approximately equal to the first width, the feed line portion having a third width less than the first width and the second width.

6. The antenna element of claim 1, wherein the upper segment has a height greater than a height of the lower segment.

7. The antenna element of claim 1, wherein the first stub includes a first arm and a first link between the first arm and the first ground plane and wherein the second stub includes a second arm and a second link between the second arm and the second ground plane.

8. The antenna element of claim 7, wherein the neck has a neck height, the neck height being approximately equal to a first link width of the first link and a second link width of the second link such that a head spacing between the head and the second conductor is approximately equal to a first arm spacing between the first arm and the first ground plane and a second arm spacing between the second arm and the second ground plane.

9. The antenna element of claim 1, wherein the first ground plane is separated from the feed line portion by a first gap and the second ground plane is separated from the feed line portion by a second gap, the antenna element further comprising a resistor between the feed line portion and at least one of the first ground plane and the second ground plane.

10. The antenna element of claim 1, further comprising a coaxial cable having a center conductor and an outer conductor, the center conductor being terminated to the feed line portion, the outer conductor being terminated to the first ground plane.

11. An antenna element comprising:

a substrate having at least a first lateral surface, a first conductor provided on the first lateral surface, said first conductor including a feed line portion and a monopole portion, the monopole portion including a neck extending from the feed line portion and a head at a distal end of the neck, the head having head segments surrounding a slot to increase a bandwidth of the first conductor to at least a first frequency band and a second frequency band, the slot having a slot width greater than a slot height of the slot;

a second conductor provided at least partially on the same, first lateral surface, wherein, the second conductor includes a first ground plane and a first stub extending from the first ground plane, the second conductor includes a second ground plane and a second stub extending from the second ground plane, the first and second ground planes are disposed on the first lateral surface adjacent to the feed line portion of the first conductor at opposite sides thereof, the first and second stubs are disposed on the first lateral surface at opposite sides of the respective first and second ground planes, the first and second stubs extend in a direction essentially parallel to the feed line portion of the first conductor, the first and second ground planes and the first and second stubs of the second conductor are arranged relative to the first conductor to form a coplanar waveguide;

wherein the head segments of the head include a lower segment below the slot, an upper segment above the slot, and side segments between the lower segment and the upper segment at opposite sides of the slot, the width of the head being defined between the side segments, the width of the head being approximately equal to a width of the second conductor defined between the first and second stubs.

12. The antenna element of claim 11, wherein the head segments and the slot are shaped to enhance operation in a Bluetooth™ frequency band, a low WIFI™ frequency band, a high WIFI™ frequency band, and a V2X dedicated short range communication (DSRC) frequency band.

13. The antenna element of claim 11, wherein the feed line portion, the first ground plane, and the second ground plane extend generally vertically, the head being located vertically above the feed line portion, the first ground plane, and the second ground plane.

14. The antenna element of claim 11, wherein the first ground plane has a first width and the second ground plane has a second width approximately equal to the first width, the feed line portion having a third width less than the first width and the second width.

15. An antenna element comprising:

a substrate having at least a first lateral surface, a first conductor provided on the first lateral surface, said first conductor including a feed line portion and a monopole portion, the monopole portion including a neck extending from the feed line portion and a head at a distal end of the neck, the head having head segments surrounding a slot to increase a bandwidth of the first conductor to cover a Bluetooth™ frequency band, a low WIFI™ frequency band, a high WIFI™ frequency band, and a V2X dedicated short range communication (DSRC) frequency band;

a second conductor provided at least partially on the same, first lateral surface, wherein, the second conductor includes a first ground plane and a first stub extending from the first ground plane, the second conductor includes a second ground plane and a second stub extending from the second ground plane, the first and second ground planes are disposed on the first lateral surface adjacent to the feed line portion of the first conductor at opposite sides thereof, the first and second stubs are disposed on the first lateral surface at opposite sides of the respective first and second ground planes, the first and second stubs extend in a direction essentially parallel to the feed line portion of the first conductor, the first and second ground planes and the first and second stubs of the second conductor are arranged relative to the first conductor to form a coplanar waveguide;

wherein the head segments of the head includes a lower segment below the slot, an upper segment above the slot, and side segments between the lower segment and the upper segment at opposite sides of the slot, the width of the head being defined between the side segments, the width of the head being approximately equal to a width of the second conductor defined between the first and second stubs.

16. The antenna element of claim 15, wherein the slot has a slot width greater than a slot height of the slot.

17. The antenna element of claim 15, wherein the feed line portion, the first ground plane, and the second ground plane extend generally vertically, the head being located vertically above the feed line portion, the first ground plane, and the second ground plane.

18. The antenna element of claim 15, wherein the upper segment has a height greater than a height of the lower segment.

19. The antenna element of claim 15, wherein the first stub includes a first arm and a first link between the first arm and the first ground plane and wherein the second stub includes a second arm and a second link between the second arm and the second ground plane; and wherein the neck has a neck height, the neck height being approximately equal to a first link width of the first link and a second link width of the second link such that a head spacing between the head and the second conductor is approximately equal to a first arm spacing between the first arm and the first ground plane and a second arm spacing between the second arm and the second ground plane.

20. The antenna element of claim 11, wherein the first stub includes a first arm and a first link between the first arm and the first ground plane and wherein the second stub includes a second arm and a second link between the second arm and the second ground plane; and wherein the neck has a neck height, the neck height being approximately equal to a first link width of the first link and a second link width of the second link such that a head spacing between the head and the second conductor is approximately equal to a first arm spacing between the first arm and the first ground plane and a second arm spacing between the second arm and the second ground plane.

* * * * *